US007310970B2

(12) United States Patent
Flanigan et al.

(10) Patent No.: US 7,310,970 B2
(45) Date of Patent: Dec. 25, 2007

(54) REFRIGERANT/OIL SEPARATOR

(75) Inventors: Paul J. Flanigan, Cicero, NY (US); Stephen L. Shoulders, Baldwinsville, NY (US)

(73) Assignee: Carrier Corporation, Farmington, CT (US)

( * ) Notice: Subject to any disclaimer, the term of this patent is extended or adjusted under 35 U.S.C. 154(b) by 80 days.

(21) Appl. No.: 11/012,794

(22) Filed: Dec. 14, 2004

(65) Prior Publication Data

US 2006/0123833 A1 Jun. 15, 2006

(51) Int. Cl.
*F25B 43/02* (2006.01)

(52) U.S. Cl. ..... 62/470; 62/85

(58) Field of Classification Search ..... 62/84, 62/85, 469, 470, 473
See application file for complete search history.

(56) References Cited

U.S. PATENT DOCUMENTS 5,443,724 A * 8/1995 Williamson et al. ..... 210/323.2
5,553,460 A * 9/1996 Isaacs ..... 62/129
5,694,780 A * 12/1997 Alsenz ..... 62/117

FOREIGN PATENT DOCUMENTS

JP 08128388 A * 5/1996

OTHER PUBLICATIONS

M.L. Munjal, Acoustics of Ducts and Mufflers, John Wiley & Sons, New York, pp. 68-70, 1987.

* cited by examiner

*Primary Examiner*—Melvin Jones
(74) *Attorney, Agent, or Firm*—Bachman & LaPointe, P.C.

(57) ABSTRACT

An apparatus for separating an oil from a refrigerant has a housing, an inlet conduit for receiving a refrigerant/oil mixture, a separator medium, a refrigerant outlet conduit, and an oil outlet conduit. The inlet conduit has an inlet external to the housing and an outlet within the housing and provides means for limiting external sounds transmitted by the housing.

14 Claims, 4 Drawing Sheets

REFRIGERANT/OIL SEPARATOR

BACKGROUND OF THE INVENTION

The invention relates to compressor systems. More particularly, the invention relates to systems having refrigerant/oil separators.

Refrigerant compressors come in a wide variety of configurations and are used in a wide variety of applications. Exemplary configurations include various screw-type compressors, scroll-type compressors, and reciprocating compressors. Exemplary applications include use in refrigeration systems, air conditioning systems, heat pump systems, chiller systems, and the like. Typical applications involve closed-loop systems.

Compressor lubrication may be important to control heating and wear. The lubricant (oil) may also help seal the compressor working element(s) relative to the housing and/or each other. There is a tendency for oil to become entrained in the refrigerant as the refrigerant passes through the compressor. For system efficiency, it is desirable to separate this oil from the compressed refrigerant before the compressed refrigerant is passed to downstream system components (e.g., condensers, expansion devices, evaporators, and the like).

A variety of refrigerant/oil separator systems exist. Exemplary systems return separated oil to the compressor. Exemplary systems are pressure driven, returning the oil to suction or near-suction conditions or up to near-discharge conditions.

Sound suppression has also been an important consideration in compressor design. Many forms of compressor mufflers have been proposed.

SUMMARY OF THE INVENTION

One aspect of the invention involves an apparatus for separating an oil from a refrigerant. The apparatus has a housing, an inlet conduit for receiving a refrigerant/oil mixture, a separator medium, a refrigerant outlet conduit, and an oil outlet conduit. The inlet conduit has an inlet external to the housing and an outlet within the housing and provides means for limiting external sounds transmitted by the housing.

In various implementations the separator medium may comprise wire batting. The inlet conduit inlet may be external to the housing. The housing may comprise a longitudinally-extending sidewall of essentially annular section and first and second domed ends. The inlet conduit outlet may be positioned to direct a refrigerant/oil inlet flow to impact the first domed end off-center. The apparatus may be in combination with a compressor, the compressor having a discharge port coupled to the inlet conduit inlet. The inlet conduit may be a single inlet conduit and the inlet conduit outlet may be a single outlet.

Another aspect of the invention involves a method for remanufacturing a refrigerant/oil separator or reengineering a configuration of the separator. An initial such separator or configuration is provided having a housing, an inlet conduit having an inlet external to the housing, a separator medium, a refrigerant outlet conduit, and an oil outlet conduit. At least one geometric parameter of a positioning of an outlet of the inlet conduit within the housing is selected to provide a desired control of external sound transmitted by the housing in a remanufactured or reengineered configuration.

In various implementations, the selecting may move the outlet of the inlet conduit closer to an interior surface portion of the housing. The selecting may effectively extend a terminal portion of the inlet conduit. The selecting may effectively extend straightly a terminal portion of the inlet conduit. The selecting may comprise an iterative optimization. The optimization may include varying of a proximity of the outlet of the inlet conduit to an interior surface portion of the housing. The optimization may further include directly or indirectly determining a parameter of said sound (e.g., until minimized or within one or more desired ranges). The determining may comprise measuring an intensity of said sound at a target frequency for pulsation of a compressor associated with the separator. Other than the inlet conduit, the separator may be left essentially unchanged.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
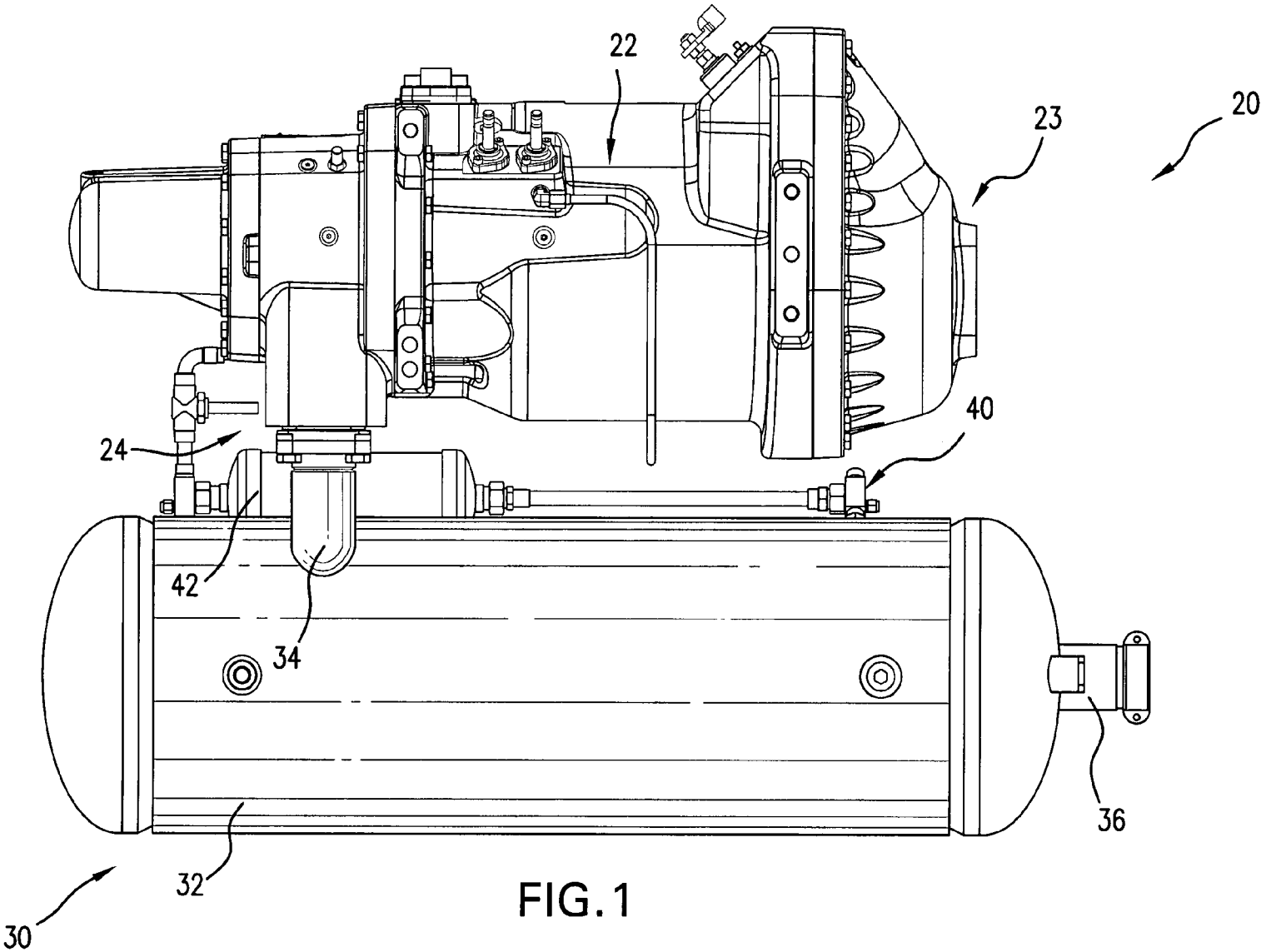
FIG. 1 is a bottom view of a compressor and separator system.
Figure 5:
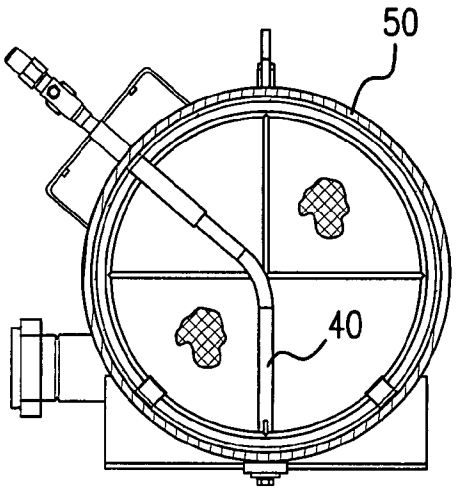
FIG. 5 is a transverse sectional view of the separator of FIG. 2 taken along line 5-5.

FIG. 1 shows system 20 including a compressor 22 having a housing extending from an inlet 23 to an outlet 24 and containing a motor and one or more working elements (e.g., rotors-not shown) for compressing a working fluid along a compression path to drive the working fluid from the inlet to the outlet.

The system 20 further includes a separator 30 including a separator vessel 32. A separator inlet conduit 34 has an upstream end coupled to the compressor outlet 24. The separator has a refrigerant outlet conduit 36. An oil return conduit 40 is coupled via a filter 42 to the compressor 22 to return lubricating oil from the separator 30 to the compressor 22. In operation, refrigerant entering the compressor inlet 23 (potentially with a relatively small oil content) entrains additional oil in the compressor so that a more substantial oil/refrigerant mixture is discharged from the compressor outlet 24. The separator 30 separates this additional oil so that the relatively oil-depleted refrigerant exits the outlet conduit 36 and the extracted oil returns to the compressor via the oil return conduit 40.

Figure 2:
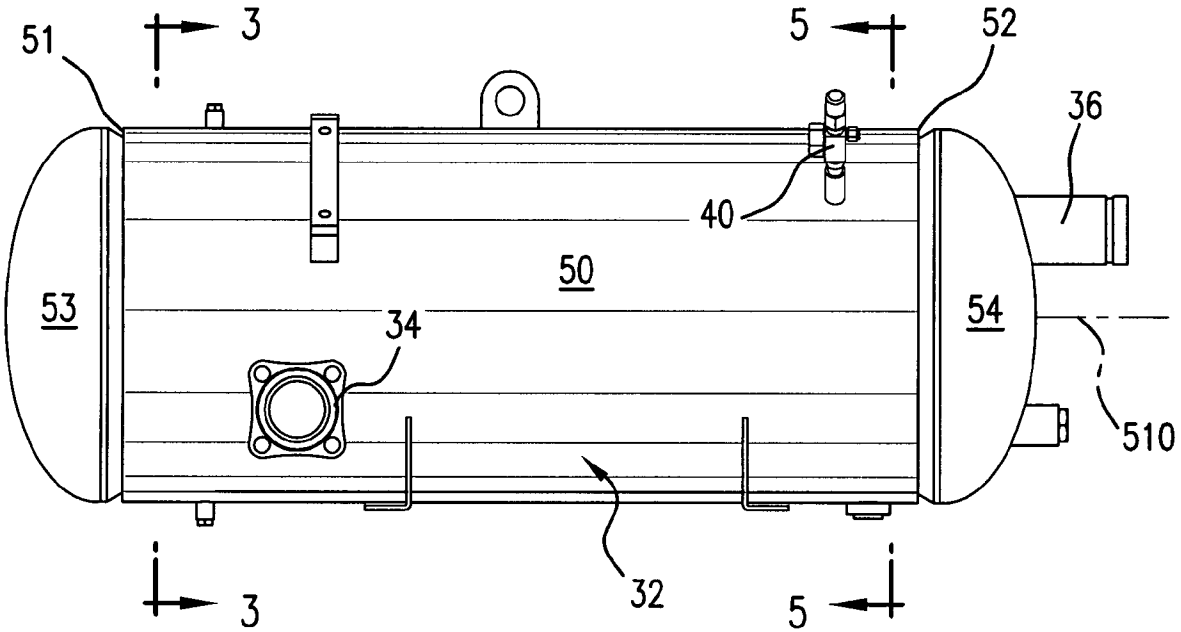
FIG. 2 is an inboard side view of the separator of FIG. 1.

FIG. 2 shows further details of the separator vessel 32. The vessel 32 includes a central essentially circular cylindrical (tubular) portion or body 50 extending about/along a central longitudinal axis 510 from an upstream end 51 to a downstream end 52. At the upstream and downstream ends, domed end pieces or heads 53 and 54 are secured (e.g., by welding). Exemplary body and head materials are alloys (e.g., steel). In the exemplary implementation, the inlet conduit 34 penetrates the body 50 relatively low and off-center generally centrally within an upstream third thereof. This positioning may be an artifact of available stock components in addition to any engineering to achieve a desired interaction of the refrigerant flow with the housing. Thus alternative conduits could be differently positioned (e.g., laterally and/or vertically on-center and/or or higher). The outlet conduit 36 penetrates the head 54 relatively high and centrally (e.g., directly above the axis 510). The oil return conduit 40 penetrates the body 50 relatively high and downstream. An alternative oil return conduit could be formed at a drain port low on the shell.

Figure 3:
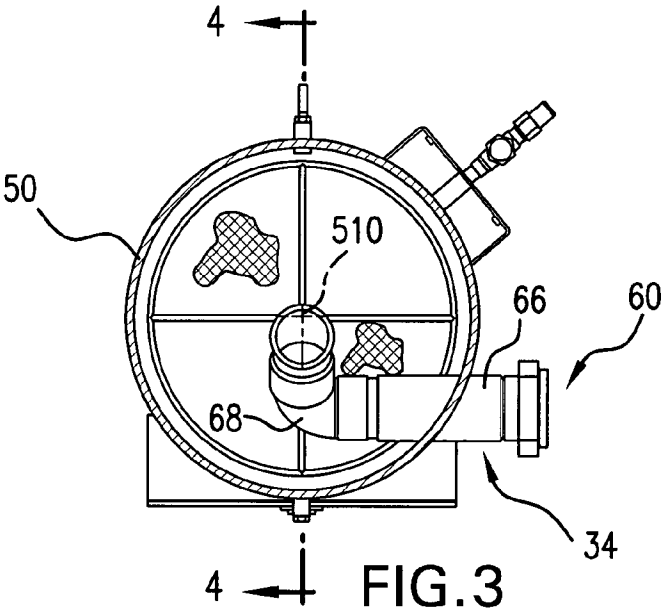
FIG. 3 is a transverse sectional view of the separator of FIG. 2, taken along line 3-3.
Figure 4:
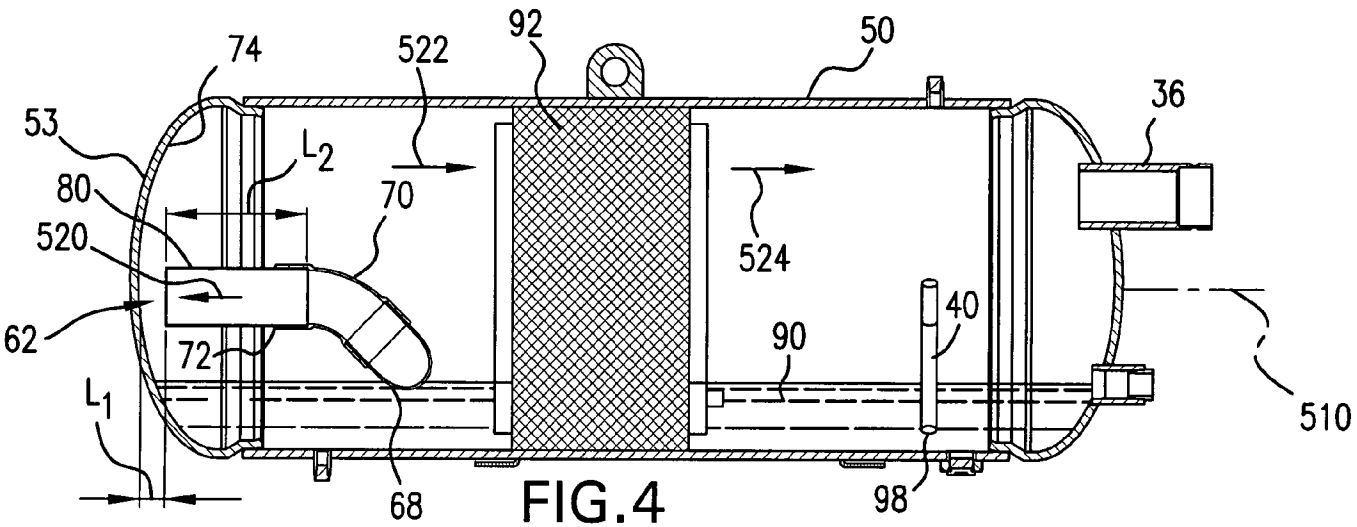
FIG. 4 is a longitudinal sectional view of the separator of FIG. 3 taken along line 4-4.

FIGS. 3 and 4 show the inlet conduit 34 as an assembly extending from an upstream end 60 (FIG. 3) to a downstream end 62 (FIG. 4). A relatively straight upstream length 66 extends from a fitting at the upstream end 60 to penetrate through the body 50. At its downstream end, the length 66 joins a first elbow 68. At its downstream end, the first elbow 68 joins a second elbow 70 whose downstream end 72 faces longitudinally toward an interior surface 74 of the upstream head 53. A straight terminal conduit section/piece 80 has an upstream end portion received within a downstream end portion of the second elbow 70. The terminal conduit section 80 extends from the downstream end of the elbow 70 and has a downstream end portion forming the conduit downstream/outlet end 62. The end 62 is located a distance $L_1$ from the surface 74. The section 80 may advantageously be coaxial or close to coaxial with the axis 510. Available off-the-shelf conduit elbow components may, however, influence the convenience of such location.

A refrigerant/oil flow 520 exits the end 62 and impinges upon the surface 74. The impingement helps separate a portion of the oil from the refrigerant. This portion may stick to the surface 74 and flow downward along such surface 74 into an accumulation 90 in the bottom of the vessel. The deflected refrigerant and remaining oil pass downstream as a flow 522 and encounter a separation medium 92 located generally centrally within the vessel. An exemplary medium comprises a metallic wire batting or a mesh assembly having sufficient porosity to pass the refrigerant while having sufficient volume-specific surface area to capture further oil. The porosity also permits oil within the accumulation 90 to flow downstream through the medium 92. As the flow 522 passes from the upstream surface of the medium to the downstream surface of the medium, oil is progressively removed and flows downward through the medium to join the accumulation 90. An essentially oil-depleted refrigerant flow 524 exits the downstream surface into a downstream volume of the vessel and may pass out through the refrigerant outlet conduit 36. An end 98 of the oil return conduit 40 is positioned to be immersed within the accumulation 90 to draw in oil for lubricating the compressor.

According to the present invention, the relationship between the inlet conduit 34 and the vessel may be tuned to provide a degree of sound attenuation. The flow 520 is subject to pressure pulsations. The pulsation frequency is a function of the compressor speed and the geometry of its working elements (e.g., the number/combination of rotor lobes in a screw-type compressor). In a specific implementation, this tuning may be achieved by appropriate selection of the separation length $L_1$. The tuning may be appropriate in a variety of circumstances. For example, the same basic separator components may be used with different compressors. Additionally or alternatively, various applications for the same basic compressor and separator may involve different characteristic operating speeds (and thus pulsation frequencies). Given the compressor configuration and target operating condition (or multiple conditions or range of conditions) an appropriate length $L_1$ may be selected to minimize effects of pulsation at a given frequency, and/or maintain desirably low target levels at one or more frequencies or over a range of frequencies. Such optimizations may be performed iteratively on actual hardware or by simulation or may be performed by calculation. An exemplary optimization involves selecting an appropriate terminal conduit piece 80 length $L_2$. This optimization may be performed, for example, by swapping out pieces 80 of different sizes or by trimming or by more complicated arrangements such as adjustable telescoping terminal sections.

The optimization may be performed as part of a remanufacturing of an existing separator or a reengineering of an existing separator configuration. For example, a baseline system may lack the terminal piece 80, instead terminating at the elbow downstream end 72. The piece 80 may be added in an appropriate length to provide the desired sound attenuation. In an exemplary optimization, in addition to measuring a sound parameter (e.g., intensity of sound near the housing) other parameters may be measured. One noteworthy parameter is backpressure. If the conduit outlet is too close to the housing wall, the proximity acts as a flow restriction thereby increasing backpressure in the conduit and upstream thereof and reducing compressor output and efficiency. The backpressure may be directly or indirectly measured (e.g., indirectly measured by measuring a downstream pressure). The optimization may involve choosing a proximity which balances any marginal gain in sound reduction against any marginal loss in backpressure.

In an original engineering, a calculated theoretical baseline separation may be determined and further optimization performed. We have used quarter wave resonator theory to establish a baseline. Such theory is discussed, in detail, in M. L. Munjal, Acoustics of Ducts and Mufflers, John Wiley & Sons, New York, pages 68-70, 1987. Such a calculation modeling the separator as a reversal-expansion extended tube resonator, however, produced an excessive separation which was downwardly optimized, reducing sound until the creation of undesirable backpressure.

Figure 6:
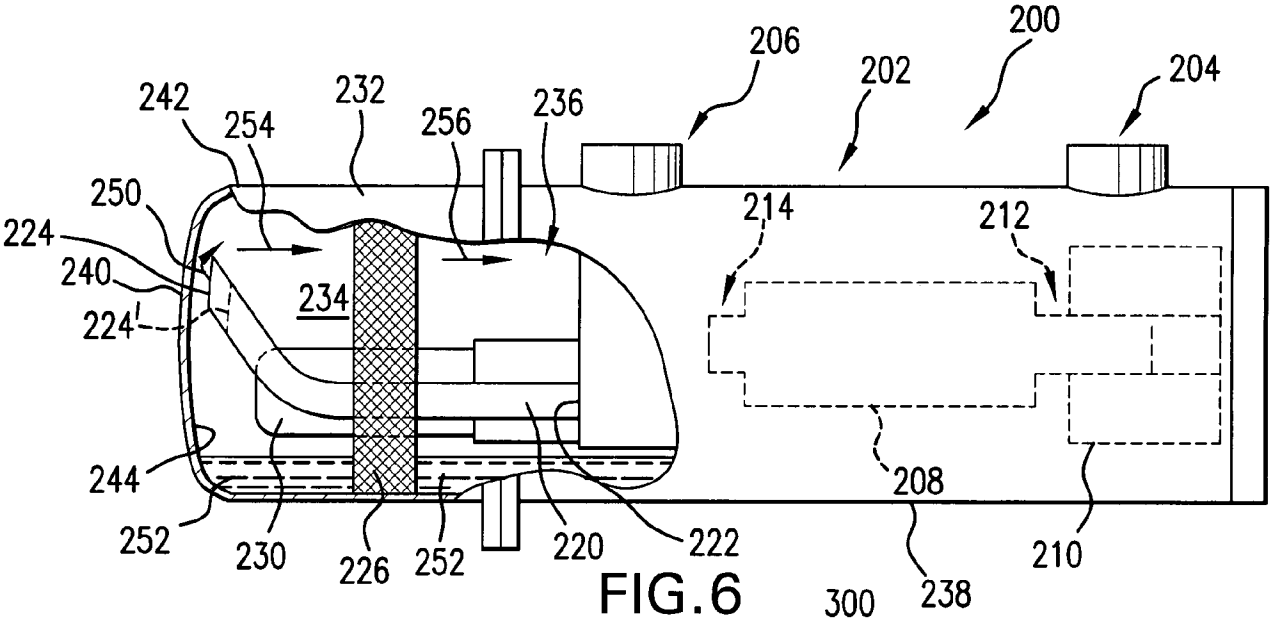
FIG. 6 is a partially schematic cut-away view of an alternate compressor and separator system.

FIG. 6 shows a compressor/separator system 200 having a common housing assembly 202. The housing assembly has a refrigerant inlet 204 and a refrigerant outlet 206. The housing assembly contains one or more working elements 208 (e.g., enmeshed lobed rotors) which may be driven by a motor 210 also within the housing assembly. When so driven, the working elements compress refrigerant from a suction plenum 212 to a discharge plenum 214. A separator inlet conduit 220 extends from an upstream/inlet end at a discharge plenum outlet 222 to a downstream/outlet end 224 and may pass through a separation medium 226. In an exemplary implementation, there may be two conduits 220 on either side of an oil filter 230.

In the exemplary system 200, the housing assembly includes a domed end member 232 accommodating the medium 226 and defining a volume 234 distally of the medium 226. A volume 236 proximally of the medium 226 may be defined by the member 232 and a housing main member 238 containing the working elements 208. The exemplary member 232 has a slightly domed end 240 joining a sidewall 242 and may have a proximal mounting flange mated to a complementary flange of the housing main member. The conduit outlet end 224 is in close facing proximity to the housing interior surface 244 along the end 240. The outlet end 224 discharges a refrigerant stream 250 containing oil to impact the surface 244 along the end 240. The impact causes a partial depletion of oil which drains down along the surface 244 to join an oil accumulation 252. A resulting partially oil-depleted deflected refrigerant stream 254 passes through the medium 226 which operates in a similar fashion to the medium 92. The medium 226 further separates oil to join the accumulation 252 and passes a substantially oil-depleted refrigerant stream 256 into the volume 236 to then be discharged through the port 206. The oil may be drawn from the accumulation and returned to lubricate the compressor through a port (not shown) communicating with suction or intermediate conditions. A basic reengineering of such an existing general configuration may involve moving the conduit outlet end/port 224 closer to the surface 244 (e.g., from a baseline location shown as 224').

Figure 7:
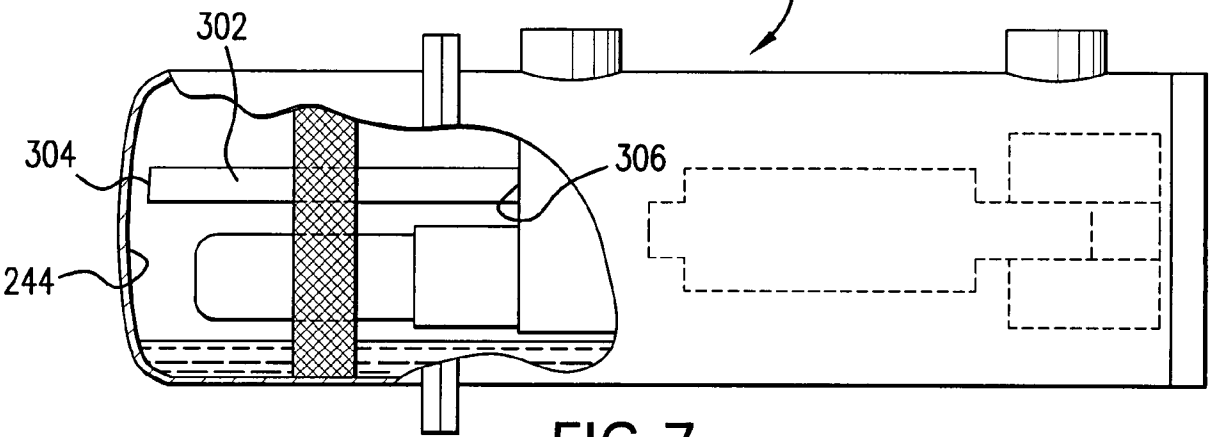
FIG. 7 is a partially schematic cut-away view of an alternate compressor and separator system.

FIG. 7 shows a system 300 formed as a more extensive reengineering of the baseline version of the system 200. This reengineering involves a rerouting of the conduit to a configuration shown as 302 and having an outlet 304. The rerouting may be accompanied by a repositioning of the discharge plenum outlet(s) to location(s) 306 (e.g., by reconfiguring a discharge end bearing case). The rerouting may address any structural problems associated with the decreased separation of the outlet 304 from the surface 244. For example, the conduit 302 may be relatively straighter than the conduit 220.

One or more embodiments of the present invention have been described. Nevertheless, it will be understood that various modifications may be made without departing from the spirit and scope of the invention. For example, when applied as a remanufacturing or reengineering, details of the existing separator configuration may influence details of any particular implementation. The principles may be implemented in more complex forms and the relevant components combined with components serving other functions. Accordingly, other embodiments are within the scope of the following claims.

What is claimed is:

1. An apparatus for separating an oil from a refrigerant comprising:

a housing comprising a longitudinally-extending sidewall of essentially annular section and first and second domed ends;

an inlet conduit having an inlet and having an outlet within the housing and providing means for limiting external sounds transmitted by the housing, the inlet conduit outlet positioned to direct a refrigerant/oil inlet flow to impact the first domed end off-center;

a separator medium comprising wire batting;

a refrigerant outlet conduit; and an oil outlet conduit.

2. The apparatus of claim 1 wherein:

the inlet conduit inlet is external to the housing.

3. The apparatus of claim 1 in combination with a compressor, the compressor having a discharge port coupled to the inlet conduit inlet.

4. An apparatus for separating an oil from a refrigerant comprising:

a housing;

a conduit having an outlet within the housing for discharging a stream of the refrigerant mixed with the oil;

a surface within the housing for directly receiving the stream discharged from the conduit outlet and deflecting the steam partially oil-depleted;

a separator medium for receiving the steam deflected and separating a further portion of the oil and passing the strewn further oil-depleted;

a refrigerant outlet conduit for discharging the stream; and an oil outlet conduit, wherein the inlet conduit outlet is positioned to essentially minimize external sounds transmitted by the housing.

5. The apparatus of claim 4 wherein:

the inlet conduit is a single inlet conduit; and the inlet conduit outlet is a single outlet of said single inlet conduit.

6. A method for remanufhcturing a refrigerant/oil separator or reengineering a configuration of the separator comprising:

providing an initial such separator or configuration having:

a housing;

an inlet conduit;

a separator medium; and a refrigerant outlet; and selecting at least one geometric parameter of a positioning of an outlet of the inlet conduit within the housing to provide a desired control of external sound transmitted by the housing in a remanufactured or reengineered configuration.

7. The method of claim 6 wherein:

the selecting moves the outlet of the inlet conduit closer to an interior surface portion of the housing.

8. The method of claim 6 wherein:

the selecting effectively extends a tenninal portion of the inlet conduit.

9. The method of claim 6 wherein:

the selecting effectively extends straightly a terminal portion of the inlet conduit.

10. The method of claim 6 wherein the selecting comprises an iterative:

varying of a proximity of the outlet of the inlet conduit to an interior surface portion of the housing; and directly or indirectly detennining a parameter of said sound.

11. The method of claim 10 wherein:

the determining comprises measuring an intensity of said sound at a target frequency for pulsation of a compressor associated with the separator.

12. The method of claim 6 wherein, other than the inlet conduit, the separator is left essentiatly unchanged.

13. An apparatus for separating an oil from a refrigerant comprising:

a housing having a longitudinally-extending sidewall of essentially annular section and first and second domed ends;

an inlet conduit having an inlet and having an outlet within the housing, the inlet conduit outlet positioned facing the first domed end to direct a refrigerant/oil inlet flow to impact the first domed end off-center;

a separator medium;

a refrigerant outlet conduit; and an oil outlet conduit.

14. An apparatus for separating an oil from a refrigerant comprising:

a housing comprising a longitudinally-extending sidewall of essentially annular section and first and second domed ends;

an inlet conduit having an inlet end having an outlet, the outlet within the housing positioned to direct a refrigerant/oil inlet flow to impact the first domed end off-center, and the inlet conduit providing means for limiting external sounds transmitted by the housing;

a separator medium;

a refrigerant outlet conduit; and an oil ouflet conduit.

* * * * *

UNITED STATES PATENT AND TRADEMARK OFFICE

CERTIFICATE OF CORRECTION

PATENT NO. : 7,310,970 B2
APPLICATION NO. : 11/012794
DATED : December 25, 2007
INVENTOR(S) : Paul J. Flanigan et al.

It is certified that error appears in the above-identified patent and that said Letters Patent is hereby corrected as shown below:

In column 5, claim 4, line 60, delete “steam” and insert --stream--.

In column 5, claim 4, line 61, delete “steam” and insert --stream--.

In column 5, claim 4, line 63, delete “strewn” and insert --stream--.

In column 6, claim 6, line 5, delete “remanufhcturing” and insert --remanufacturing--.

In column 6, claim 8, line 23, delete “tenninal” and insert --terminal--.

In column 6, claim 10, line 32, delete “detennining” and insert --determining--.

In column 6, claim 14, line 58, delete “end” and insert --and--.

In column 6, claim 14, line 65, delete “ouflet” and insert --outlet--.

Signed and Sealed this

Seventeenth Day of June, 2008

JON W. DUDAS
*Director of the United States Patent and Trademark Office*